US008427379B2

(12) United States Patent
Rothkopf et al.

(10) Patent No.: US 8,427,379 B2
(45) Date of Patent: Apr. 23, 2013

(54) MODULAR MATERIAL ANTENNA ASSEMBLY

(75) Inventors: Fletcher R. Rothkopf, Los Altos, CA (US); Phillip M. Hobson, Menlo Park, CA (US); Adam Mittleman, San Francisco, CA (US); Anna-Katrina Shedletsky, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 348 days.

(21) Appl. No.: 12/859,701

(22) Filed: Aug. 19, 2010

(65) Prior Publication Data

US 2012/0044123 A1 Feb. 23, 2012

(51) Int. Cl.
*H01Q 1/24* (2006.01)

(52) U.S. Cl.
USPC ..... 343/702; 343/878

(58) Field of Classification Search ..... 343/702, 343/878
See application file for complete search history.

(56) References Cited

U.S. PATENT DOCUMENTS

| | | | |
|---|---|---|---|
| 4,074,419 | A | 2/1978 | Hannie et al. |
| 5,045,971 | A | 9/1991 | Ono et al. |
| 5,128,829 | A | 7/1992 | Loew |
| 5,180,644 | A | 1/1993 | Bresin et al. |
| 5,373,300 | A | 12/1994 | Jenness et al. |
| 5,468,947 | A | 11/1995 | Danielson et al. |
| 5,568,358 | A | 10/1996 | Nelson et al. |
| 5,737,183 | A | 4/1998 | Kobayashi et al. |
| 5,784,256 | A | 7/1998 | Nakamura et al. |
| 5,796,575 | A | 8/1998 | Podwalny et al. |
| 6,038,328 | A | 3/2000 | Hsu |
| 6,137,890 | A | 10/2000 | Markow |
| 6,144,368 | A | 11/2000 | Ooka et al. |
| 6,153,834 | A | 11/2000 | Cole et al. |
| 6,408,171 | B1 | 6/2002 | Schuelke et al. |
| 6,427,017 | B1 | 7/2002 | Toki |
| 6,452,811 | B1 | 9/2002 | Tracy et al. |
| 6,536,589 | B2 | 3/2003 | Chang |
| 6,746,797 | B2 | 6/2004 | Benson et al. |

(Continued)

FOREIGN PATENT DOCUMENTS

| | | |
|---|---|---|
| CN | 1079348 | 12/1993 |
| CN | 1188387 | 7/1998 |

(Continued)

OTHER PUBLICATIONS

Evaluation Report for Utility Model Patent ZL2009201775365 dated May 28, 2010.

(Continued)

*Primary Examiner* — Anh Tran

(57) ABSTRACT

A modular material antenna assembly is provided that includes an antenna block having a portion with a shape that interlocks with a corresponding portion of an electrically non-conductive frame and secures the antenna block to the electrically non-conductive frame. The electrically non-conductive frame is attached to an interior of an electrically conductive housing so that the electrically non-conductive frame and the electrically conductive housing form an integrated structure. An antenna flex is then mechanically secured to the antenna block. The antenna flex may also be electrically connected to a circuit board. The frame is designed to support a cover glass for the portable electronic device and may be affixed to a housing. The dielectric constant of the antenna block is substantially less than the dielectric constant of the frame.

26 Claims, 11 Drawing Sheets

U.S. PATENT DOCUMENTS

| | | | | |
|---|---|---|---|---|
| 6,757,157 | B2 | 6/2004 | Lammintaus et al. | |
| 6,781,824 | B2 | 8/2004 | Krieger et al. | |
| 6,819,946 | B2 | 11/2004 | Hansson | |
| 6,838,810 | B1 | 1/2005 | Bovio et al. | |
| 6,847,522 | B2 | 1/2005 | Fan et al. | |
| 6,894,651 | B2 | 5/2005 | Yokochi et al. | |
| 6,929,879 | B2 | 8/2005 | Yamazaki | |
| 6,957,085 | B2 | 10/2005 | Shin et al. | |
| 7,149,557 | B2 | 12/2006 | Chadha | |
| 7,190,802 | B2 | 3/2007 | Rains et al. | |
| 7,236,357 | B2 | 6/2007 | Chen | |
| 7,297,439 | B2 | 11/2007 | Yamazaki et al. | |
| 7,352,584 | B1 | 4/2008 | Sung | |
| 7,412,267 | B2 | 8/2008 | Eaton et al. | |
| 7,432,860 | B2 | 10/2008 | Huynh | |
| 7,515,431 | B1 | 4/2009 | Zadesky et al. | |
| 7,553,055 | B2 | 6/2009 | Liu | |
| 7,558,054 | B1 | 7/2009 | Prest et al. | |
| 7,558,057 | B1 | 7/2009 | Naksen et al. | |
| 7,558,396 | B2 | 7/2009 | Liu et al. | |
| 7,564,424 | B2 | 7/2009 | Umehara | |
| 7,583,987 | B2 | 9/2009 | Park | |
| 7,620,175 | B2 | 11/2009 | Black et al. | |
| 7,663,607 | B2 | 2/2010 | Hotelling et al. | |
| 7,668,332 | B2 | 2/2010 | Williams et al. | |
| 7,688,574 | B2 | 3/2010 | Zadesky et al. | |
| 7,697,281 | B2 | 4/2010 | Dabov et al. | |
| 2002/0102870 | A1 | 8/2002 | Burns et al. | |
| 2002/0107044 | A1 | 8/2002 | Kuwata et al. | |
| 2002/0114143 | A1 | 8/2002 | Morrison et al. | |
| 2003/0003945 | A1 | 1/2003 | Saiki et al. | |
| 2003/0081392 | A1 | 5/2003 | Cady et al. | |
| 2004/0084244 | A1 | 5/2004 | Zurek et al. | |
| 2004/0203518 | A1 | 10/2004 | Zheng et al. | |
| 2005/0014537 | A1 | 1/2005 | Gammon et al. | |
| 2005/0088778 | A1 | 4/2005 | Chen et al. | |
| 2005/0095745 | A1 | 5/2005 | Sapir | |
| 2006/0067070 | A1 | 3/2006 | Otsuki | |
| 2006/0157842 | A1 | 7/2006 | Goodwin | |
| 2006/0262500 | A1 | 11/2006 | Huang et al. | |
| 2007/0058821 | A1 | 3/2007 | Welsh et al. | |
| 2007/0081303 | A1 | 4/2007 | Lam et al. | |
| 2007/0160228 | A1 | 7/2007 | Yang et al. | |
| 2008/0025547 | A1 | 1/2008 | Yun et al. | |
| 2008/0037765 | A1 | 2/2008 | Finney et al. | |
| 2008/0037770 | A1 | 2/2008 | Emmert | |
| 2008/0062660 | A1 | 3/2008 | Weber et al. | |
| 2008/0069384 | A1 | 3/2008 | Kim et al. | |
| 2008/0101026 | A1 | 5/2008 | Ali | |
| 2008/0165139 | A1 | 7/2008 | Hotelling et al. | |
| 2008/0165485 | A1 | 7/2008 | Zadesky et al. | |
| 2008/0266774 | A1 | 10/2008 | Tracey et al. | |
| 2008/0316116 | A1 | 12/2008 | Hobson et al. | |
| 2008/0316121 | A1 | 12/2008 | Hobson et al. | |
| 2009/0015510 | A1 | 1/2009 | Nakata et al. | |
| 2009/0049773 | A1 | 2/2009 | Zadesky et al. | |
| 2009/0059485 | A1 | 3/2009 | Lynch et al. | |
| 2009/0067141 | A1 | 3/2009 | Dabov et al. | |
| 2009/0155681 | A1 | 6/2009 | Lin et al. | |
| 2009/0160712 | A1 | 6/2009 | Breiter et al. | |
| 2009/0185045 | A1 | 7/2009 | Rosenbalt | |
| 2009/0201652 | A1 | 8/2009 | Chew et al. | |
| 2009/0245564 | A1 | 10/2009 | Mittleman et al. | |
| 2009/0257189 | A1 | 10/2009 | Wang et al. | |
| 2009/0257613 | A1 | 10/2009 | Khamashta et al. | |
| 2009/0302804 | A1 | 12/2009 | Park et al. | |
| 2010/0008040 | A1 | 1/2010 | Weber et al. | |
| 2010/0073247 | A1 | 3/2010 | Arkko et al. | |
| 2010/0271283 | A1* | 10/2010 | Sung et al. | 343/906 |
| 2012/0001806 | A1* | 1/2012 | Hsiung | 343/702 |

FOREIGN PATENT DOCUMENTS

| | | | |
|---|---|---|---|
| CN | 2477363 | | 2/2002 |
| CN | 2757458 | | 2/2002 |
| CN | 1361970 | | 7/2002 |
| CN | 1380720 | | 11/2002 |
| CN | 1508906 | | 6/2004 |
| CN | 2619419 | | 6/2004 |
| CN | 2779773 | | 5/2006 |
| CN | 1870676 | | 11/2006 |
| DE | 10252308 | | 4/2004 |
| EP | 0534290 | | 3/1993 |
| EP | 1209880 | | 2/2002 |
| EP | 1257147 | | 11/2002 |
| EP | 1441489 | | 7/2004 |
| EP | 1 732 230 | A2 | 12/2006 |
| EP | 1870956 | | 12/2007 |
| EP | 2343872 | | 7/2011 |
| GB | 2137425 | | 10/1984 |
| JP | 2003-11194 | | 4/2003 |
| JP | 2004-213498 | | 7/2004 |
| JP | 2005130156 | A | 5/2005 |
| KR | 20070047650 | A | 5/2007 |
| WO | WO 2008/152438 | | 12/2008 |
| WO | WO 2009/056143 | | 5/2009 |

OTHER PUBLICATIONS

Canadian Office Action for 2,735,999 dated Sep. 12, 2011.
Japanese Office Action for 2011-526076 dated Sep. 9, 2011.
Australian Examiner's First Report for 2011203145dated Aug. 25, 2011.
Chinese Office Action for 201020179389.8 dated Feb. 16, 2011.
International Search Report for PCT/US2009/050879 dated Dec. 27, 2010.
Written Opinion for PCT/US2009/050879 dated Dec. 27, 2010.
European Office Action for 09790546.7 dated Dec. 21, 2011.
Office Action for U.S. Appl. No. 12/712,900 dated Jan. 5, 2012.
Written Opinion for PCT/US2011/048404 dated Feb. 13, 2012.
Notice of Allowance for U.S. Appl. No. 12/712,900 dated Apr. 25, 2012.
International Preliminary Report on Patentability for PCT/US2009/080879 dated Mar. 8, 2011.
Partial Search Report for PCT/US2009/050879 dated Oct. 7, 2010.
International Search Report for PCT/US2011/048404 dated Feb. 13, 2012.
Korean Office Action for KR 10-2011-7021855 dated Feb. 6, 2012.
Japanese Final Office Action for 2011-526076 dated Feb. 22, 2012.
Office Action dated Oct. 25, 2010 in CN Application No. 201020179389.8.
Notice of Allowance dated Sep. 3, 2010 in U.S. Appl. No. 12/205,826.
Office Action dated Jul. 12, 2010 in U.S. Appl. No. 12/205,826.
Ho et al., "Cost Effective Integrated Housing and Printed Circuit Module for Battery Pack," ip.com Prior Art Database, Apr. 29, 2004, 6 pgs.
U.S. Appl. No. 12/950,793, filed Nov. 19, 2010.
U.S. Appl. No. 12/859,712, filed Aug. 19, 2010.
U.S. Appl. No. 61/377,866, filed Aug. 27, 2010.
Office Action dated Sep. 30, 2009 in U.S. Appl. No. 12/205,824.
Notice of Allowance dated Dec. 21, 2009 in U.S. Appl. No. 12/205,824.
U.S. Appl. No. 12/859,694, filed Aug. 19, 2010.
U.S. Appl. No. 12/859,702, filed Aug. 19, 2010.
U.S. Appl. No. 12/859,711, filed Aug. 19, 2010.

* cited by examiner

MODULAR MATERIAL ANTENNA ASSEMBLY

BACKGROUND

1. Field of the Invention

The invention relates to consumer products, and more particularly, to a modular material antenna assembly.

2. Description of the Related Art

A portable electronic device can take many forms such as, for example, a tablet computing device along the lines of an iPad™, a portable communication device such as an iPhone™, or a portable media player, such as an iPod™, each manufactured by Apple Inc. of Cupertino, Calif. Such devices often have wireless communication mechanisms, in order to provide wireless communication between the portable device and base stations, cell phone towers, desktop computers, etc. Common wireless communication mechanisms include IEEE 802.11a, b, g, and n (commonly known as "WiFi"), Worldwide Interoperability for Microwave Access (WiMAX), and cellular communications mechanisms such as Global System for Mobile Communications (GSM) and Code Division Multiple Access (CDMA). What is needed is improved techniques for integrating antennas into portable electronic devices to enable wireless communication.

SUMMARY

Broadly speaking, the embodiments disclosed herein describe a modular material antenna assembly that includes an antenna block having a portion with a shape that interlocks with a corresponding portion of an electrically non-conductive frame and secures the antenna block to the electrically non-conductive frame. The electrically non-conductive frame is attached to an interior of an electrically conductive housing so that the electrically non-conductive frame and the electrically conductive housing form an integrated structure. An antenna flex is then mechanically supported by the antenna block, and electrically connected to a circuit board. The frame is designed to support a cover glass for the portable electronic device and may be affixed to a housing. The dielectric constant of the antenna block is substantially less than the dielectric constant of the frame. In one embodiment, the antenna block is made of Cyclo Olefin Polymer (COP), while the frame is made of a glass-filled plastic. The resultant difference in dielectric constant, in conjunction with the interlocking portions of the frame and antenna block, as well as the difference in dielectric loss tangent, improves antenna performance.

In another embodiment, a method for assembling a portable electronic device is provided. In this embodiment, an electrically conductive housing is provided. Then, an electrically non-conductive frame is glued to an interior of the electrically conductive housing, forming an integrated structure. The electrically non-conductive frame is formed of a frame material having a first dielectric constant. Then, an antenna block is secured to the frame by interlocking a portion of the antenna block having a first shape with a portion of the frame having a second shape corresponding to the first shape. The antenna block is formed of an antenna block material having a second dielectric constant substantially less than the first dielectric constant. An antenna flex is then supported by the antenna block.

In another embodiment, a computer readable medium is provided having computer code for affixing an electrically non-conductive frame to an interior of an electrically conductive housing, forming an integrated structure, wherein the electrically non-conductive frame is formed of a frame material having a first dielectric constant. This may include computer code for controlling robotic arms to glue the electrically non-conductive frame to an interior of the electrically conductive housing. The computer readable medium may also include computer code for securing an antenna block to the frame by interlocking a portion of the antenna block having a first shape with a portion of the frame having a second shape corresponding to the first shape. This may include computer code for controlling robotic arms to perform the interlocking. The computer readable medium may also include computer code for causing the antenna flex to be mechanically supported by the antenna block. This may include computer code for controlling an automatic screwdriver to screw in the antenna feed to the antenna block and to an electrically conducing bracket welded to the housing.

Other aspects and advantages will become apparent from the following detailed description taken in conjunction with the accompanying drawings which illustrate, by way of example, the principles of the invention.

BRIEF DESCRIPTION OF THE DRAWINGS

The described embodiments will be readily understood by the following detailed description in conjunction with the accompanying drawings, wherein like reference numerals designate like structural elements, and in which.

DETAILED DESCRIPTION OF THE DESCRIBED EMBODIMENTS

In the following detailed description, numerous specific details are set forth to provide a thorough understanding of the concepts underlying the described embodiments. It will be apparent, however, to one skilled in the art that the described embodiments can be practiced without some or all of these specific details. In other instances, well known process steps have not been described in detail in order to avoid unnecessarily obscuring the underlying concepts.

Broadly speaking, the embodiments disclosed herein describe a modular material antenna assembly that includes an antenna block having a portion with a shape that interlocks with a corresponding portion of an electrically non-conductive frame and secures the antenna block to the electrically non-conductive frame. The electrically non-conductive frame is attached to an interior of an electrically conductive housing so that the electrically non-conductive frame and the electrically conductive housing form an integrated structure. An antenna flex is then mechanically supported by the antenna block and electrically connected to a circuit board. The frame is designed to support a cover glass for the portable electronic device and may be affixed to a housing. The dielectric constant of the antenna block is substantially less than the dielectric constant of the frame. In one embodiment, the antenna block is made of Cyclo Olefin Polymer (COP) while the frame is made of a glass-filled plastic. The resultant difference in dielectric constant, in conjunction with the interlocking portions of the frame and antenna block, as well as the difference in dielectric loss tangent, improves antenna performance.

Figure 1:
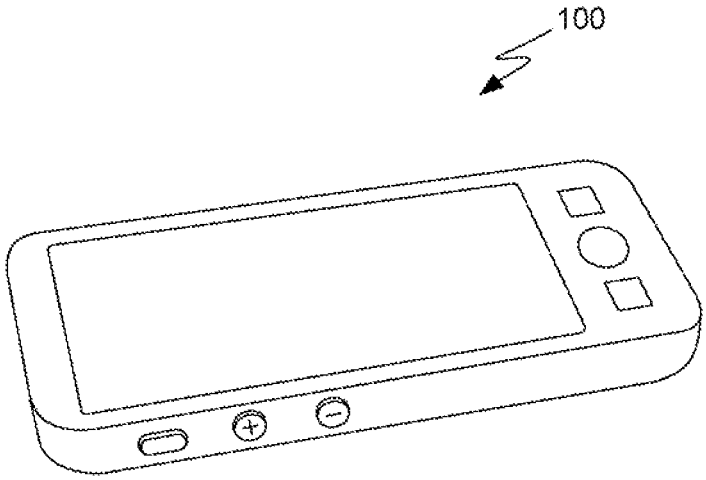
FIG. 1 shows a perspective top view illustrating a representative consumer product in accordance with the described embodiments.

FIG. 1 shows a perspective top view illustrating a representative consumer product 100 in accordance with the described embodiments. Consumer product 100 can take many forms, not the least of which includes a portable media player such as an iPod™ or iPod Touch™, a smartphone such as an iPhone™, and a tablet computer such as an iPad™, each manufactured by Apple Inc. of Cupertino, Calif. Consumer product 100 can utilize an internal antenna to send and/or receive wireless communications. These wireless communications may be performed for many different purposes. For example, as will be described later, the wireless communications may be performed for mobile phone communications, WiFi communications, Bluetooth™ communications, wireless broadband communications, etc. Making these communications more efficient and effective provides for an improved user experience when using consumer product 100.

Figure 2:
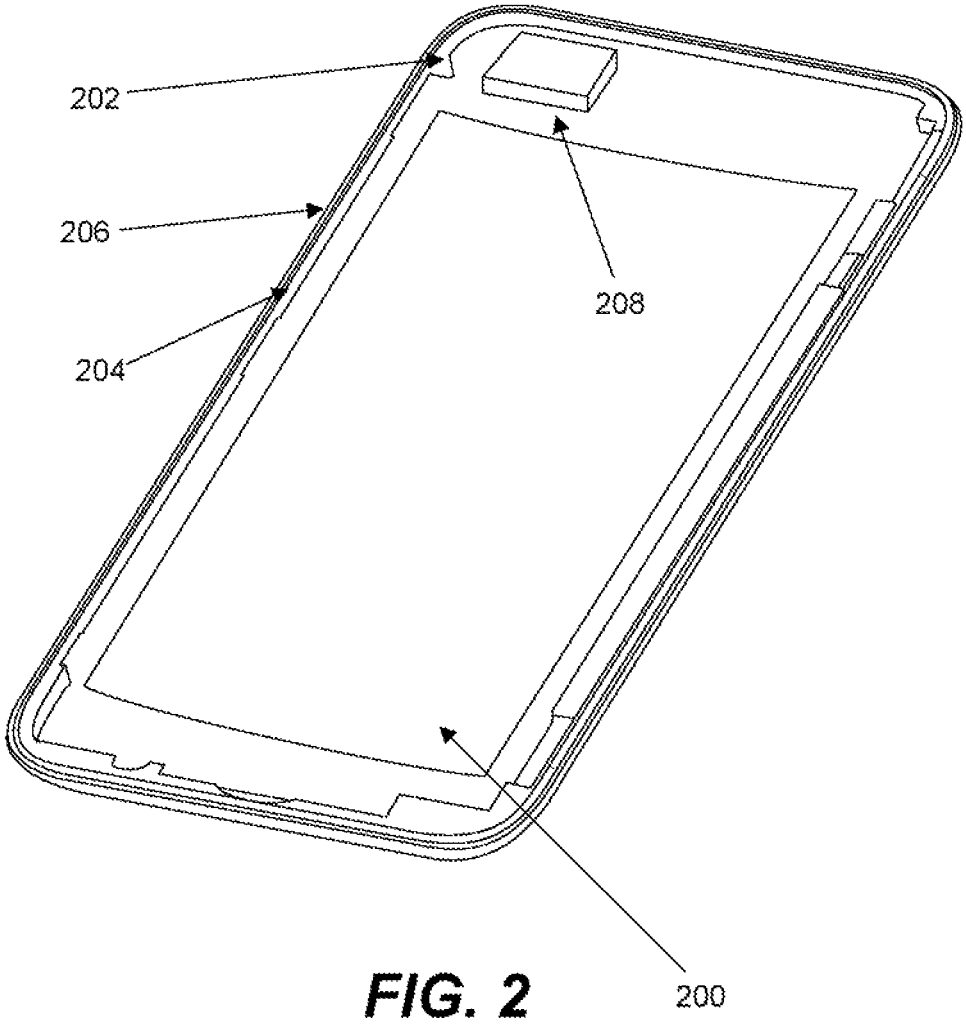
FIG. 2 shows a perspective top view of a modular material antenna assembly in accordance with one embodiment.

FIG. 2 shows a perspective top view of a modular material antenna assembly in accordance with one embodiment. Here, housing 200 is provided, which is made of an electrically conductive material. An example of an electrically conductive material suitable for use with this embodiment is stainless steel, although one of ordinary skill in the art will recognize that there are many other potential materials that would be suitable with this embodiment and the claims should not be construed as being limited to stainless steel unless expressly stated. Frame 202 is affixed to housing 200, and generally may act to support a front face (not pictured) of the device. The front face may be made of transparent material, such as glass, and may act to cover the device, yet permit a user to view through the cover to a display (not pictured) underneath. This display may also act as an input device. For example, the display may be one of many different types of touchscreens.

In order to support the cover, frame 202 may include rim 204 having flange portion 206. In one embodiment, the cover is glued to rim 204 about flange 206, thus sealing the entire device. Thus, rim 204 acts not only as a support for the cover but also as a junction area where the cover may be affixed to the frame. Frame 202 may be made of an electrically non-conductive frame material, such as a glass filled plastic. One example glass-filled plastic suitable for use in frame 202 is KALIX™, manufactured by Solvay Advanced Polymers of Alpharetta, Ga. KALIX™ includes 50% glass-fiber reinforced high-performance nylon. One of ordinary skill in the art will recognize that there are many other potential frame materials that would be suitable for use with this embodiment, and the claims should not be construed as being limited to KALIX™ or any other glass-filled plastic unless expressly stated.

The dielectric constant of frame 202 is substantially greater than the dielectric constant of antenna block 208. Glass-filled plastic, for example, has a dielectric constant of about 5, while COP, which, as described earlier, can be used as an antenna block material, may have a dielectric constant of approximately 2.25. Additionally, the dielectric loss tangent of frame 202 is substantially greater than the dielectric loss tangent of antenna block 208. Glass-filled plastic, for example, has a dielectric loss tangent of between 2.5 and 4, whereas antenna block 208 composed of COP may have a dielectric loss tangent of approximately 0.0005. Dielectric loss tangent is a parameter of a dielectric material that quantifies its inherent dissipation of electromagnetic energy. The term refers to the angle in a complex plane between the resistive (lossy) component of an electromagnetic field and its reactive (lossless) component. The smaller the dielectric loss tangent, the less "lossy" the antenna reception.

Figure 3:
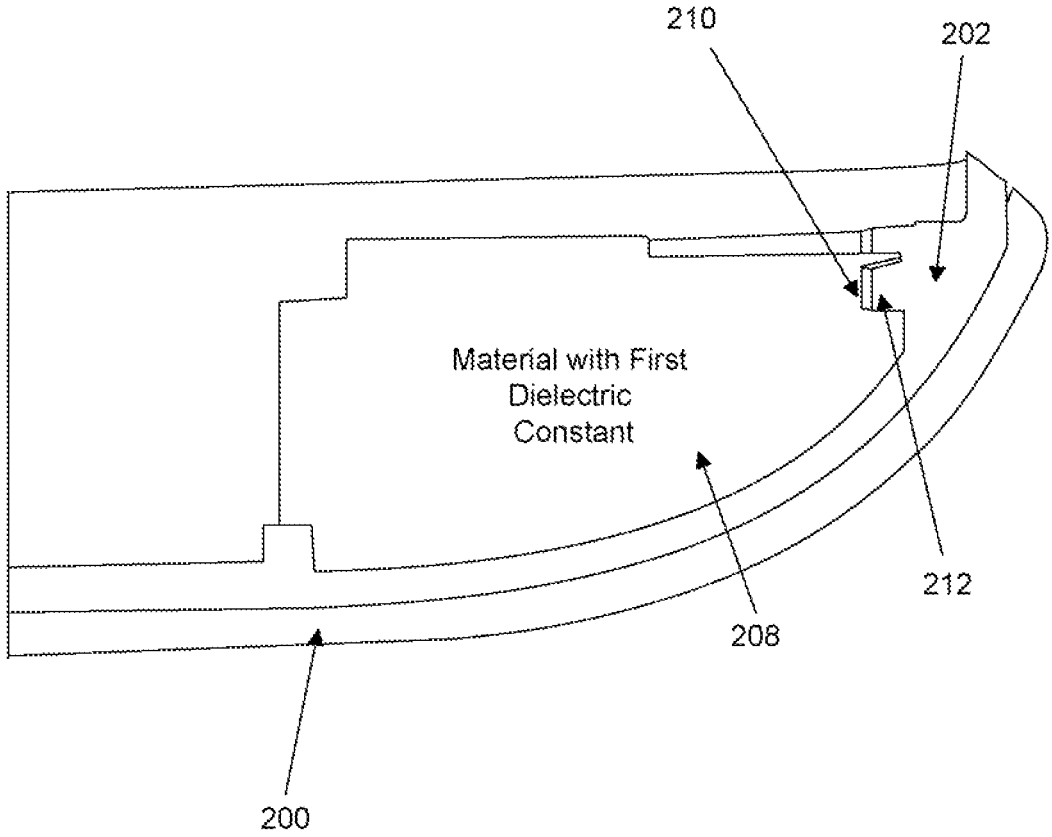
FIG. 3 shows a first cross section of a modular material antenna assembly in accordance with one embodiment.
Figure 4:
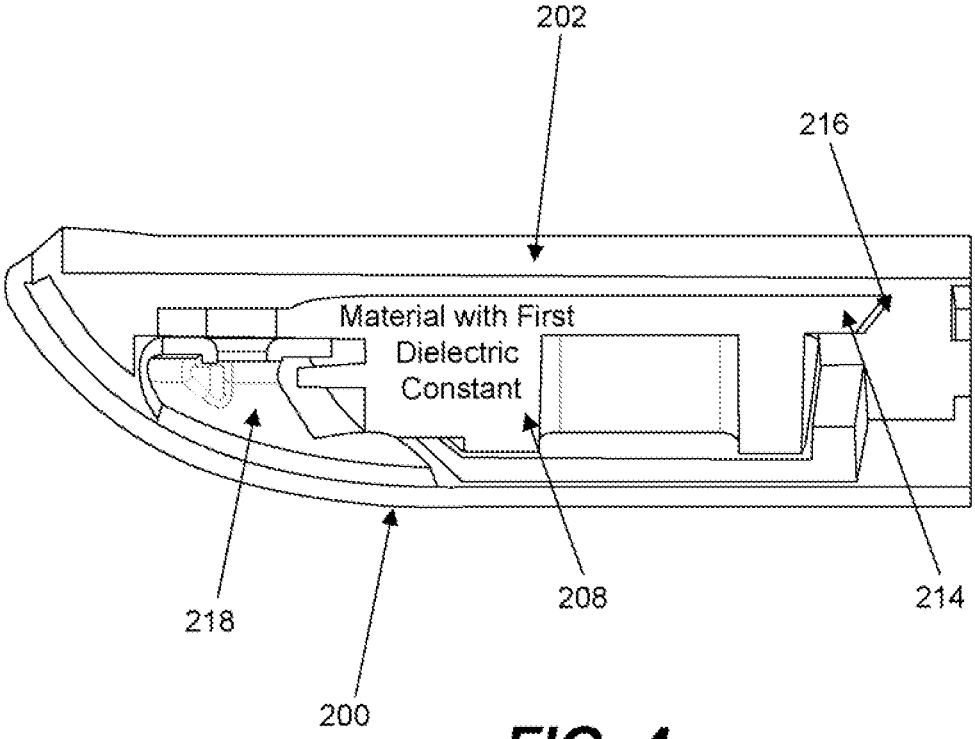
FIG. 4 shows a second cross section of a modular material antenna assembly in accordance with one embodiment.

In addition to being formed of an antenna block material that, as just described, has a dielectric constant substantially less than the frame material, antenna block 208 additionally has a portion with a shape that interlocks with a corresponding portion of frame 202 and secures the antenna block to the frame. This is depicted in FIGS. 3 and 4. The device may additionally contain a printed circuit board (not pictured) Integrated circuits and other electrical components may be mounted to circuit board and may be used to operate the device as well as control the display. The printed circuit board can include a processor or processors configured to perform various functions of the device.

FIG. 3 shows a first cross section of a modular material antenna assembly in accordance with one embodiment. This cross section represents the view from the side of the device in FIG. 2. As can be seen in FIG. 3, antenna block 208 contains a portion 210 with a shape that interlocks with a corresponding portion 212 of frame 202. Here, the interlocking portions include a tabbed portion 212 of frame 202, with a notched portion 210 of antenna block 208. However, one of ordinary skill in the art will recognize that there may be many different ways in which to interlock these components in a manner that secures antenna block 208 to frame 202, and the claims should not be limited to any particular shape(s) unless expressly stated.

FIG. 4 shows a second cross section of a modular material antenna assembly in accordance with one embodiment. This cross section represents the view from the top end of the device in FIG. 3. Here, antenna block 208 has another portion 214 with a shape that interlocks with a corresponding portion 216 of frame 202. This portion 214 is tabbed portion on the antenna block 208 side, while portion 216 is a notched portion 216 on the frame 202 side. By alternating the tabbed and notched portions between antenna block 208 and frame 202, antenna block 208 can be secured more tightly to frame 202. It should be noted that it is not necessary for there to be any particular number of these corresponding portions to interlock antenna block 208 and frame 202. It is enough to have one set of interlocking portions in order for the antenna block 208 to be secured to the frame 202. Nevertheless, additional interlocking portions can be provided to provide additional strength to the coupling of the two components. Additionally depicted in this figure is bracket 218, which connects to housing 200 and permits electrical conductivity between an item screwed into the bracket 218 via screw hole 222 and housing 200. Bracket 218 may be welded to the housing 200. Bracket 218 may be composed of an electrically conductive material.

Figure 5:
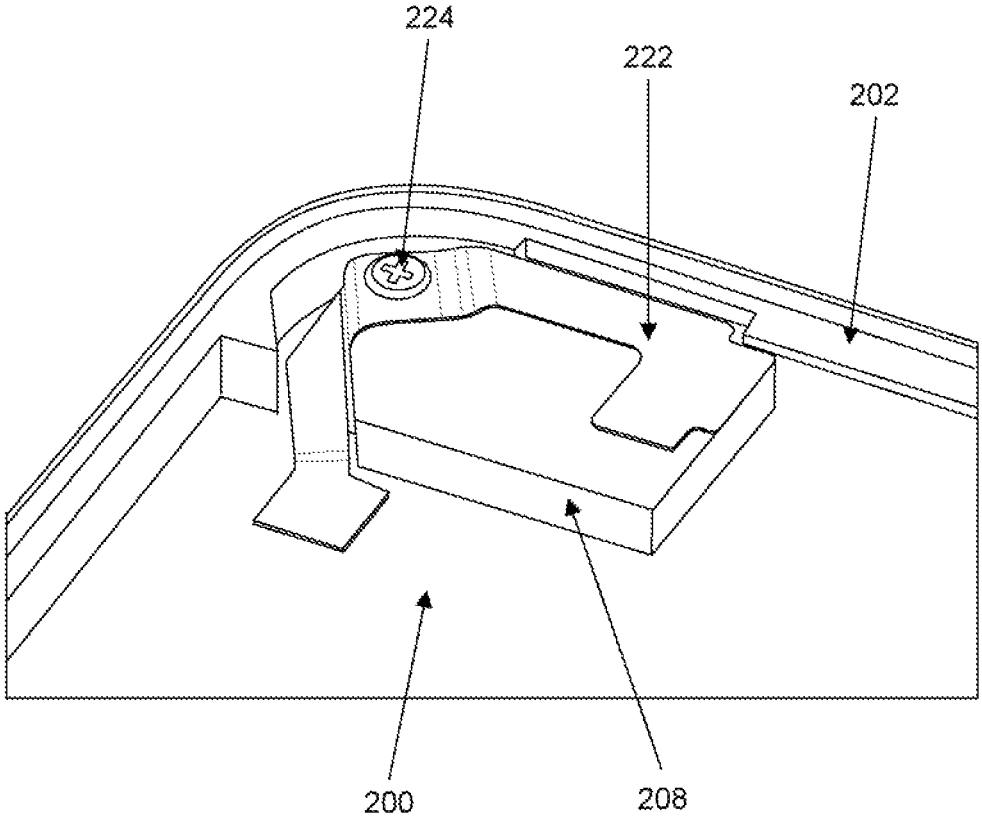
FIG. 5 shows an expanded view of a top perspective view of a modular material antenna assembly in accordance with one embodiment.

FIG. 5 shows an expanded view of a top perspective view of a modular material antenna assembly in accordance with one embodiment. Here, an antenna flex 222 has been mechanically secured to the top of antenna block 208. Antenna flex 222 may be secured to antenna block 208 through the use of a screw 224 into bracket 218, depicted in FIG. 4. It should be noted that it is not necessary for bracket 218 to be a separate component from housing 200, and in fact in one embodiment, bracket 218 is integrally formed with housing 200. Antenna flex 222 may also be electrically connected to a circuit board (not pictured) of the consumer product, and electrical components on the circuit board can additionally be electrically connected housing 200 to ground each of the components.

Additionally, antenna block 208 may be ground to housing 200. In one example, an electrically conductive spring (known as a grounding spring) may be used to perform this task. The spring may itself have shapes that interlock with corresponding portions of antenna block 208 and housing 200, in order to secure the grounding spring. Such a spring is designed to deform elastically, which can reduce the effect of bumps or other trauma to the consumer device. The elastic deformability of the spring can allow the spring to be retained between antenna block 208 and housing 200 even during drop events or other such impacts.

While antenna block 208 is depicted in FIGS. 2-5 as having a particular shape, it is not necessary for the antenna block generally to be formed in any particular shape. Indeed, the shape of the antenna block may vary based on a number of different factors, including the design and form of neighboring structures, ease of construction, ease of installation, and how tightly the antenna block is to be secured to the frame. The manner in which the frame and antenna block interlock with each other can also affect antenna performance, and it is believed that having the interlocking portions be made of materials having different dielectric constants further improves antenna performance above. In other words, the interlocking aspect of the different dielectric constant materials increases antenna performance above and beyond what would occur if the different dielectric constant materials were connected without interlocking portions.

Additionally, the shape of the antenna block may alter the characteristics of wireless reception of the device. Certain shapes and/or sizes may generally increase or decrease wireless reception. Additionally, certain shapes and sizes may increase wireless reception when the device is used in certain manners and decrease wireless reception when the device is used in other manners. For example, the position of a user's hand while holding the device may alter the wireless reception characteristics of the device. This affect may be reduced or eliminated by providing more room between the antenna block and the portion of the housing at which the user typically grasps the device, or by the placement of an electrically non-conductive and physically buffering material such as a rubber bumper. As such, the antenna block may be designed to balance all of the above factors in the most efficient manner possible.

The antenna block, frame, and housing may be manufactured from any suitable material, using any suitable process. This may include, for example, metals, composite materials, plastic, etc. These components may be manufactured using any suitable approach, such as, for example, forming, forging, extruding, machining, molding, stamping, and any other suitable manufacturing process, or combinations thereof.

The antenna block may be configured to operate over any suitable band or bands to cover any existing or new services of interest. If desired, multiple antenna blocks may be provided to cover more bands, or one or more antennas may be provided with wide-bandwidth resonating elements to cover multiple communications bands of interest. Unless expressly disclaimed, nothing in this application should be construed as limiting the claimed embodiments to a single antenna block.

Figure 6:
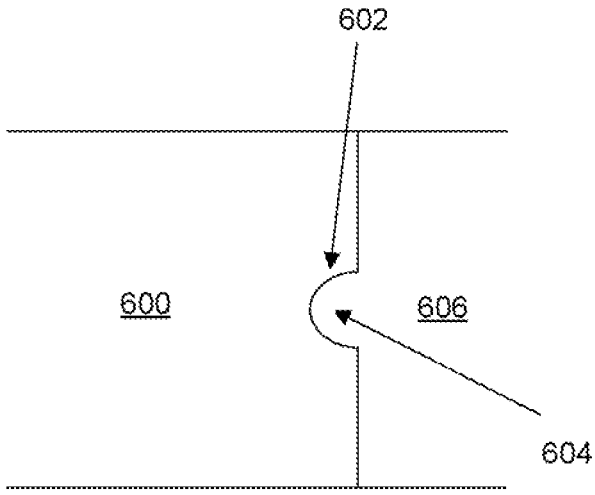
FIG. 6 depicts an alternative interlocking shape in accordance with an embodiment.

FIG. 6 depicts an alternative interlocking shape in accordance with an embodiment. This figure depicts a close-up of the interlocking shape area of the antenna block and frame, and the other features of the antenna block and frame (and perhaps other interlocking shapes elsewhere on those elements) are not depicted. Here, antenna block 600 contains a rounded notched portion 602, which interlocks with a rounded tabbed portion 604 of frame 606. By manufacturing the interlocking portions with rounded shapes as opposed to substantially rectangular shapes, assembly becomes easier because the shapes slide together more quickly than many rectangular shapes. This must be counterbalanced, however, by the fact that a rounded shape may not provide as much resistance to separation as substantially rectangular shapes.

Figure 7:
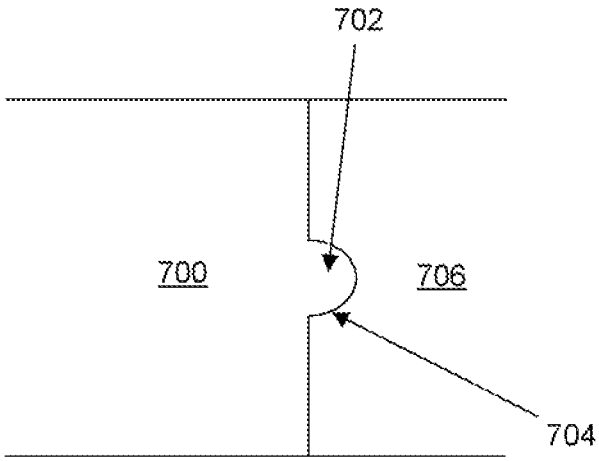
FIG. 7 depicts an alternative locking shape in accordance with another embodiment.

FIG. 7 depicts an alternative locking shape in accordance with another embodiment. This figure depicts a close-up of the interlocking shape area of the antenna block and frame, and the other features of the antenna block and frame (and perhaps other interlocking shapes elsewhere on those elements) are not depicted. This embodiment is similar to that shown in FIG. 6, except that antenna block 700 contains a rounded tabbed portion 702, which interlocks with a rounded notched portion 704 of frame 706. As with the embodiment in FIG. 6, the rounded design may speed up assembly, but may also be less reliable as far as locking antenna block 700 to frame 706.

Figure 8:
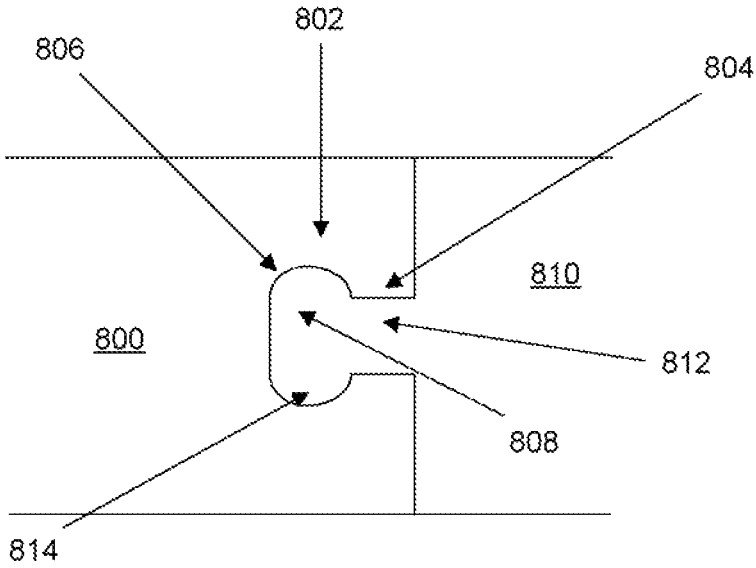
FIG. 8 depicts an alternative interlocking shape in accordance with an embodiment.

FIG. 8 depicts an alternative interlocking shape in accordance with an embodiment. This figure depicts a close-up of the interlocking shape area of the antenna block and frame, and the other features of the antenna block and frame (and perhaps other interlocking shapes elsewhere on those elements) are not depicted. Here, antenna block 800 contains a notched portion 802 having a rectangular portion 804 and a rounded portion 806. Notched portion 802 interlocks with tabbed portion 808 of frame 810. Tabbed portion 808 contains rectangular portion 812 and rounded portion 814. This design provides exceptional locking ability, providing significant resistance to separation of antenna block 800 and frame 810. This must be counterbalanced, however, by the fact that assembly of such interlocking portions may be difficult or even impossible if there are multiple such notched portions 802 and tabbed portions 808 in the device. This embodiment may be ideal, however, in cases where there is only a single interlocking portion for each of the antenna block and frame.

Figure 9:
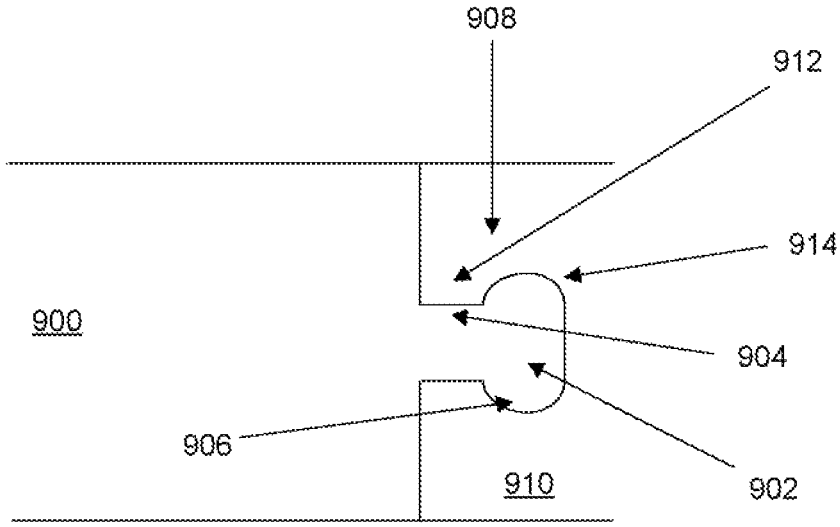
FIG. 9 depicts an alternative locking shape in accordance with another embodiment.

FIG. 9 depicts an alternative locking shape in accordance with another embodiment. This figure depicts a close-up of the interlocking shape area of the antenna block and frame, and the other features of the antenna block and frame (and perhaps other interlocking shapes elsewhere on those elements) are not depicted. This embodiment is similar to that shown in FIG. 8, except that antenna block 900 contains a tabbed portion 902 having a rectangular portion 904 and a rounded portion 906. Tabbed portion 902 interlocks with notched portion 908 of frame 910. Notched portion 908 contains rectangular portion 912 and rounded portion 914. As with the embodiment in FIG. 8, this embodiment may be ideal in cases where there is only a single interlocking portion for each of the antenna block and frame.

Figure 10:
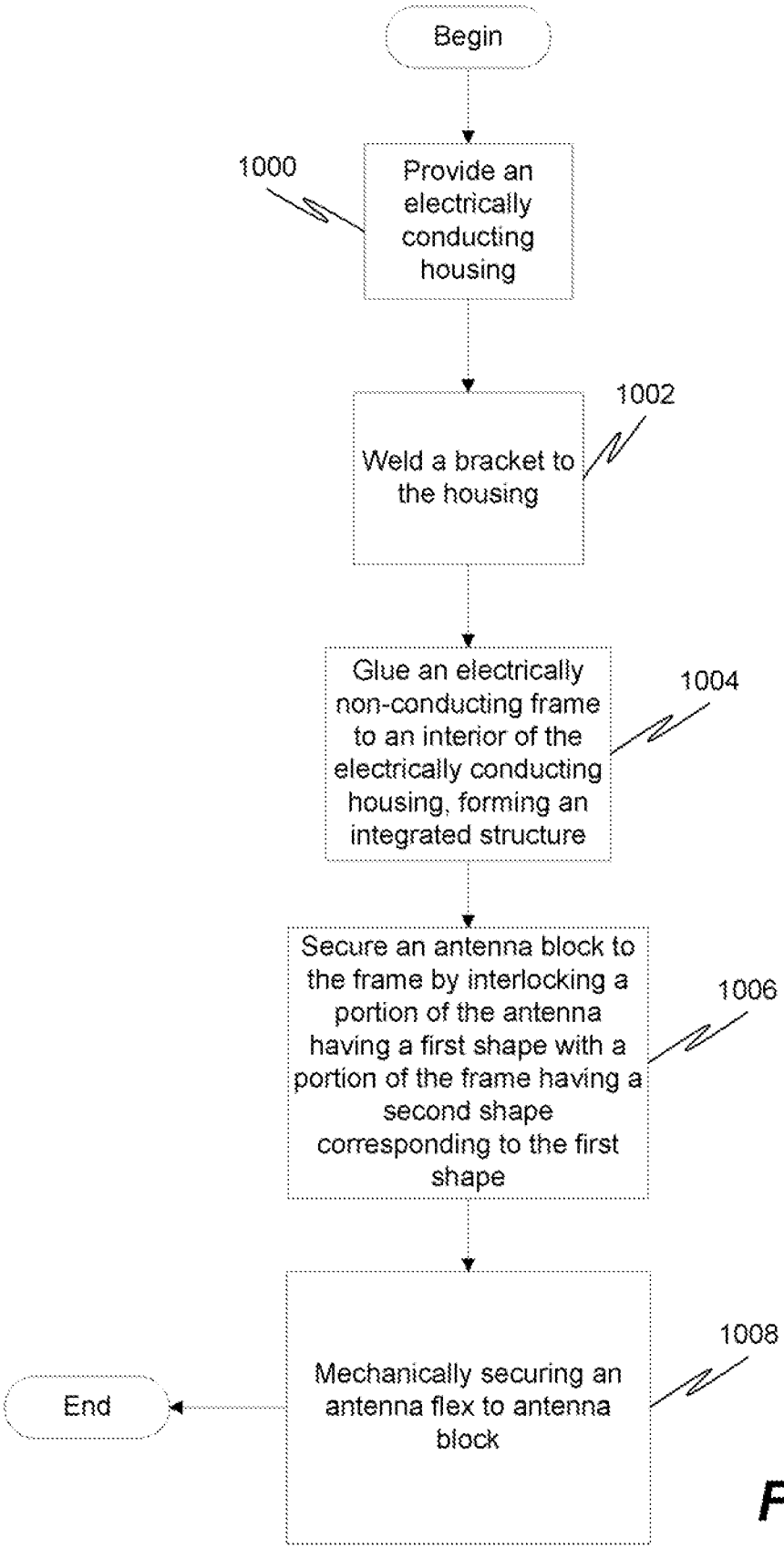
FIG. 10 is a flow diagram depicting a method for assembling a portable electronic device in accordance with one embodiment.

FIG. 10 is a flow diagram depicting a method for assembling a portable electronic device in accordance with one embodiment. At 1000, an electrically conductive housing is provided. This housing may be made of, for example, stainless steel. At 1002, a bracket is welded to the housing. This bracket may be also made of an electrically conductive material. At 1004, an electrically non-conductive frame is glued, or otherwise secured, to an interior of the electrically conductive housing, forming an integrated structure. The electrically non-conductive frame is formed of a frame material having a first dielectric constant. At 1006, an antenna block is secured to the frame by interlocking a portion of the antenna having a first shape with a portion of the frame having a second shape corresponding to the first shape. The antenna block is formed of an antenna block material having a second dielectric constant substantially less than the first dielectric constant. At 1008, an antenna flex is mechanically secured to the antenna block. The antenna flex may also be electrically connected to a circuit board.

Figure 11:
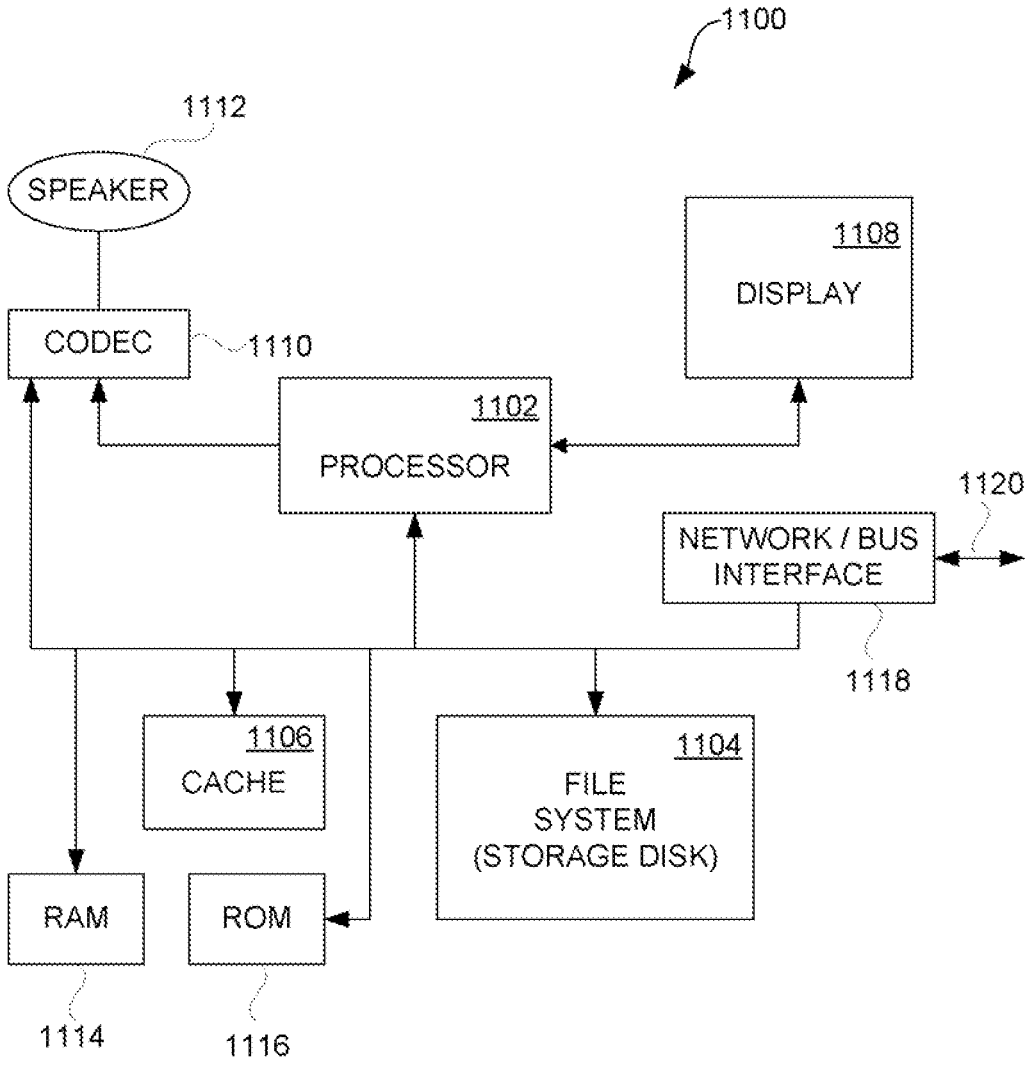
FIG. 11 is a block diagram of a portable consumer device according to one embodiment of the invention.

FIG. 11 is a block diagram of a portable consumer device according to one embodiment of the invention. The portable consumer device 1100 can utilize the modular material antenna assembly in accordance with any of the embodiments described above. Portable consumer device 1100 includes a processor 1102 that pertains to a microprocessor or controller for controlling the overall operation of portable consumer device 1100. Portable consumer device 1100 stores media data pertaining to media items in a file system 1104 and a cache 1106. File system 1104 is, typically, a storage disk or a plurality of disks. File system 1104 typically provides high capacity storage capability for portable consumer device 1100. File system 1104 can store not only media data but also non-media data (e.g., when operated in a disk mode). However, since the access time to file system 1104 is relatively slow, portable consumer device 1100 can also include a cache 1106. Cache 1106 is, for example, Random-Access Memory (RAM) provided by semiconductor memory. The relative access time to cache 1106 is substantially shorter than for file system 1104. However, cache 1106 does not have the large storage capacity of file system 1104. Further, file system 1104, when active, consumes more power than does cache 1106. The power consumption is often a concern when portable consumer device 1100 is a portable consumer device that is powered by a battery (not shown).

In one embodiment, portable consumer device 1100 serves to store a plurality of media items (e.g., songs) in file system 1104. When a user desires to have the portable consumer device play a particular media item, a list of available media items is displayed on display 1108. Then, using a touchpad built into display 1108, a user can select one of the available media items. Processor 1102, upon receiving a selection of a particular media item, supplies the media data (e.g., an audio file) for the particular media item to a coder/decoder (CODEC) 1110. CODEC 1110 then produces analog output signals for a speaker 1112. Speaker 1112 can be a speaker internal to the portable consumer device 1100 or external to the portable consumer device 1100. For example, headphones or earphones that connect to portable consumer device 1100 would be considered an external speaker. Speaker 1112 can not only be used to output audio sounds pertaining to the media item being played, but also to output sound effects and cellular phone call audio. The sound effects can be stored as audio data on the portable consumer device 1100, such as in file system 1104, cache 1106, ROM 1114 or RAM 1116. A sound effect can be output in response to a user input or a system request. When a particular sound effect is to be output to speaker 1112, the associated sound effect audio data can be retrieved by processor 1102 and supplied to CODEC 1110 which then supplies audio signals to speaker 1112. In the case where audio data for a media item is also being output, processor 1100 can process the audio data for the media item as well as the sound effect. In such case, the audio data for the sound effect can be mixed with the audio data for the media item. The mixed audio data can then be supplied to CODEC 1110 which supplies audio signals (pertaining to both the media item and the sound effect) to speaker 1112.

Portable consumer device 1100 also includes a network/bus interface 1118 that couples to a data link 1120. Data link 1118 allows the portable consumer device 1100 to couple to a host computer. Data link 1118 can be provided over a wired connection or a wireless connection. In the case of a wireless connection, network/bus interface 1118 can include a wireless transceiver.

In one embodiment, the internal antenna is utilized for Wi-Fi communications, such as those in accordance with the IEEE 802.11 a, b, g, and n standards. Wi-Fi is commonly used to wirelessly network computing devices, and as such it is common for computer-related information to be transferred over the Wi-Fi connection. Nevertheless, other types of communications have been increasingly conducted over Wi-Fi connections, including, for example, video phone calls, the downloading of electronic books to tablet computers, etc. The modular material antenna assembly described herein can be utilized for such Wi-Fi communications. In another embodiment, the internal antenna is utilized for short-range wireless networking communications, such as those in accordance with the Bluetooth™ standard.

In another embodiment, the internal antenna is utilized for wireless broadband (WiBB) communications, such as IEEE 802.16, also known as WiMAX, Local Multipoint Distribution Service (LMDS), and Multichannel Multipoint Distribution Service (MMDS). In another embodiment, the internal antenna is utilized for cellular communications. This may include communications conducted using one of many different cellular communications protocols, such as Global System for Mobile Communications (GSM), General Packet Radio Service (GPRS), Code Division Multiple Access (CDMA), Evolution-Data Optimized (EV-DO), Enhanced Data Rates for GSM Evolution (EDGE), 3GSM, Digital Enhanced Cordless Telecommunications (DECT), Digital AMPS (IS-136/TDMA), and Integrated Digital Enhanced Network (iDEN).

In some embodiments, the internal antenna is a broadband antenna that can be configured to receive multiple different frequency bands. Additional bands are expected to be deployed in the future as new wireless services are made available. Antenna designs of various embodiments may be configured to operate over any suitable band or bands to cover any existing or new services of interest. If desired, multiple antennas may be provided to cover more bands or one or more antennas may be provided with wide-bandwidth resonating elements to cover multiple communications bands of interest. An advantage of using a broadband antenna design that covers multiple communications bands of interest is that this makes it possible to reduce device complexity and cost and to minimize the amount of a handheld device that is allocated towards antenna structures.

A broadband design may be used for one or more antennas in wireless devices when it is desired to cover a relatively larger range of frequencies without providing numerous individual antennas or using a tunable antenna arrangement. If desired, a broadband antenna design may be made tunable to expand its bandwidth coverage or may be used in combination with additional antennas. In general, however, broadband designs tend to reduce or eliminate the need for multiple antennas and tunable configurations.

In addition, embodiments of the present invention further relate to computer storage products with a computer-readable medium that have computer code thereon for performing various computer-implemented operations. The media and computer code may be those specially designed and constructed for the purposes of the present invention, or they may be of the kind well known and available to those having skill in the computer software arts. Examples of computer-readable media include, but are not limited to: magnetic media such as hard disks, floppy disks, and magnetic tape; optical media such as CD-ROMs and DVDs and holographic devices; magneto-optical media such as floptical disks; and hardware devices that are specially configured to store and execute program code, such as application-specific integrated circuits (ASICs), programmable logic devices (PLDs) and ROM and RAM devices. Examples of computer code include machine code, such as produced by a compiler, and files containing higher level code that are executed by a computer using an interpreter.

In one embodiment, a computer-readable medium is provided that includes computer program instructions for performing the various steps of assembling a portable electronic device. Specifically, the computer program instruction may act to control various automatic installation components, such as, for example, robotic arms, automatic screwdrivers, etc. that can assemble the device without the need for human intervention (or, at least, minimizing human intervention). In this way, the computer instructions may be programmed to control a machine to weld a bracket to an electrically conductive housing, glue an electrically non-conductive frame to the interior of the electrically conductive housing, secure the antenna block to the frame by interlocking the portion of the antenna having a first shape with a portion of the frame having a second shape corresponding to the first shape, mechanically secure the antenna flex to the antenna block by, for example, screwing a screw through the antenna flex and the bracket, etc.

The many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A portable electronic device comprising:

an electrically conductive housing;

an electrically non-conductive frame formed of a frame material having a first dielectric constant and attached to an interior of the electrically conductive housing, the housing and the frame forming an integrated structure;

an antenna block formed of an antenna block material having a second dielectric constant that is substantially less than the first dielectric, wherein a portion of the antenna block has a shape that interlocks with a corresponding portion of the frame and secures the antenna block to the frame; and an antenna flex mechanically secured to the antenna block.

2. The portable electronic device of claim 1, wherein the frame material is glass-filled plastic.

3. The portable electronic device of claim 1, wherein the antenna block material is Cyclo Olefin Polymer.

4. The portable electronic device of claim 1, wherein the electrically conductive housing comprises stainless steel.

5. The portable electronic device of claim 1, wherein the electrically non-conductive frame contains a rim designed to support a cover glass of the portable electronic device.

6. The portable electronic device of claim 5, wherein the rim contains a flange.

7. The portable electronic device of claim 1, wherein the portion of the antenna block that has a shape that interlocks with a corresponding portion of the frame is a notched portion and the corresponding portion of the frame is a tabbed portion.

8. The portable electronic device of claim 1, wherein the antenna block further comprises a second portion that has a shape that interlocks with a second corresponding portion of the frame.

9. The portable electronic device of claim 1, wherein the antenna flex is mechanically secured to a conductive bracket welded to the electrically conductive housing, and electrically connected to a circuit board of the portable electronic device.

10. A method for assembling a portable electronic device, comprising:

providing an electrically conductive housing;

gluing an electrically non-conductive frame to an interior of the electrically conductive housing, forming an integrated structure, wherein the electrically non-conductive frame is formed of a frame material having a first dielectric constant;

securing an antenna block to the frame by interlocking a portion of the antenna block having a first shape with a portion of the frame having a second shape corresponding to the first shape, wherein the antenna block is formed of an antenna block material having a second dielectric constant substantially less than the first dielectric constant; and mechanically securing an antenna flex to the antenna block.

11. The method of claim 10, further comprising welding a conductive bracket to the housing and wherein the electrically connecting includes connecting the antenna flex to the antenna block and to the conductive bracket.

12. The method of claim 11, wherein connecting the antenna flex to the antenna block includes screwing a screw through a hole in the antenna flex and through a hole in the antenna block.

13. The method of claim 11, wherein connecting the antenna flex to the conductive bracket includes screwing a screw through a hole in the antenna flex and through a hole in the bracket.

14. The method of claim 10, further comprising connecting the antenna flex to a system board so that the antenna block can be used to send and receive wireless communications.

15. The method of claim 14, wherein the wireless communications are performed via a WiFi protocol.

16. The method of claim 14, wherein the wireless communications are performed via a Bluetooth™ protocol.

17. The method of claim 14, wherein the wireless communications are performed via a short range broadband standard.

18. The method of claim 14, wherein the wireless communications are performed via a cellular telephone protocol.

19. The method of claim 10, wherein the first dielectric constant is approximately 5.

20. The method of claim 10, wherein the second dielectric constant is approximately 2.25.

21. The method of claim 10, wherein the frame material has a dielectric loss tangent of between 2.5 and 4.

22. The method of claim 10, wherein the frame material has a dielectric loss tangent of approximately 0.0005.

23. A computer readable medium for storing in non-transitory tangible form computer instructions executable by a processor for assembling a portable electronic device, the computer readable medium comprising:

computer code for affixing an electrically non-conductive frame to an interior of an electrically conductive housing, forming an integrated structure, wherein the electrically non-conductive frame is formed of a frame material having a first dielectric constant;

computer code for securing an antenna block to the frame by interlocking a portion of the antenna block having a first shape with a portion of the frame having a second shape corresponding to the first shape, wherein the antenna block is formed of an antenna block material having a second dielectric constant substantially less than the first dielectric constant; and computer code for mechanically securing an antenna flex to the housing and to the antenna block.

24. The computer readable medium of claim 23, further comprising:

computer code for securing an electrically conductive bracket to the housing and to the antenna flex.

25. The computer readable medium of claim 23, wherein the computer code for affixing include computer code for controlling a robotic arm to glue the electrically non-conductive frame to an interior of the electrically conductive housing.

26. The computer readable medium of claim 24, wherein the computer code for electrically connecting an antenna flex to the housing and to the antenna block includes computer code for controlling an automatic screwdriver to drive in a screw attaching the antenna flex to the antenna block and to the bracket.

* * * * *

UNITED STATES PATENT AND TRADEMARK OFFICE

CERTIFICATE OF CORRECTION

PATENT NO. : 8,427,379 B2
APPLICATION NO. : 12/859701
DATED : April 23, 2013
INVENTOR(S) : Fletcher R. Rothkopf et al.

It is certified that error appears in the above-identified patent and that said Letters Patent is hereby corrected as shown below:

In the Claims:

In claim 25, column 11, line 20, delete "the computer code for affixing include" and insert -- the computer code for affixing includes --

Signed and Sealed this
Ninth Day of July, 2013

Teresa Stanek Rea
*Acting Director of the United States Patent and Trademark Office*